US006074736A

United States Patent [19]

Kagawa

[11] Patent Number: 6,074,736

[45] **Date of Patent: *Jun. 13, 2000**

[54] PULL-TOP CAN

[76] Inventor: Seiji Kagawa, 77-1-1409, Sezakicho, Soka, Saitama-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/822,534

[22] Filed: Mar. 24, 1997

[30] Foreign Application Priority Data

Mar. 27, 1996 [JP] Japan ..... 8-072473
Oct. 28, 1996 [JP] Japan ..... 8-285177

[51] Int. Cl.[7] ..... B32B 3/02

[52] U.S. Cl. ..... 428/308.4; 428/315.7; 428/315.9; 428/317.1; 428/317.7; 428/458; 428/480; 220/265; 220/906

[58] Field of Search ..... 428/308.4, 315.7, 428/315.9, 317.1, 317.7, 458, 480; 220/265, 266, 268, 269, 276, 906

[56] References Cited

U.S. PATENT DOCUMENTS 5,257,923 11/1993 Kagawa ..... 425/290

FOREIGN PATENT DOCUMENTS 0 313 149 4/1989 European Pat. Off. .
0 612 608 8/1994 European Pat. Off. .
673756 9/1995 European Pat. Off. .

OTHER PUBLICATIONS

WPI, Section Ch, Derwent Publications Ltd., London, GB, & JP 47 019 630 B (Matsuki T) Abstract.

*Primary Examiner*—Elizabeth M. Cole
*Attorney, Agent, or Firm*—Kenyon & Kenyon

[57] ABSTRACT

A pull-top can protect the contents from the material of the body and lid without impairing the opening properties of the pull-top mechanism attached to the lid, and maintain the quality of the contents such as beverages, beer, and any other seafood for a long period of time. A pull-top can includes a body having an open top and an inner surface laminated with an organic resin film, and an aluminum lid caulked at the cut-open portion of the body and having a pull-top mechanism. The inner surface of the lid on the body side is laminated with a porous organic resin film having a large number of small through pores by an adhesive layer sandwiched between the inner surface of the lid and the porous organic resin film.

5 Claims, 7 Drawing Sheets

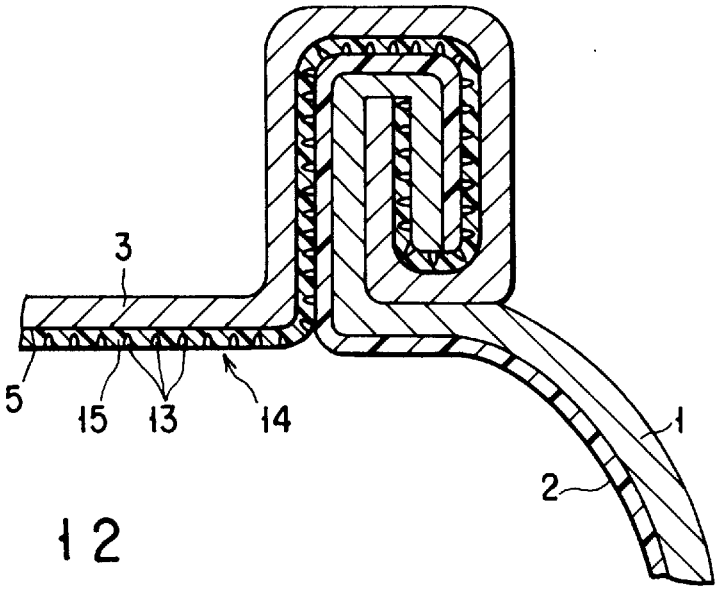
FIG. 12
FIG. 13
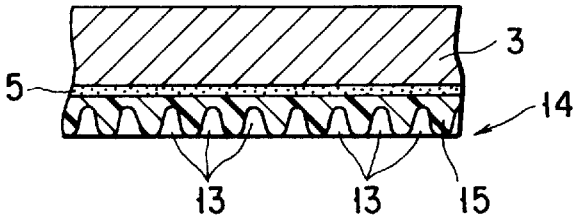
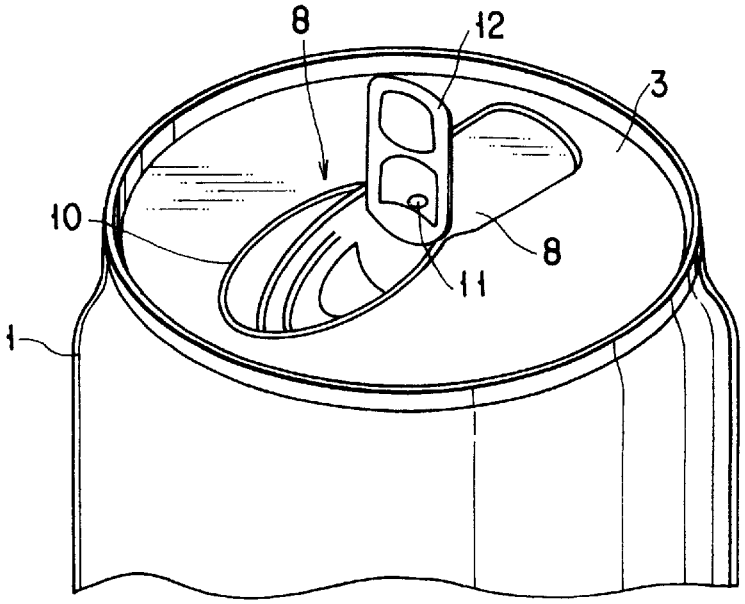
FIG. 14

PULL-TOP CAN

BACKGROUND OF THE INVENTION

The present invention relates to a pull-top can and, more particularly, to a pull-top can having an improved lid.

In recent years, as a can containing beverages, beer, any other seafood, or the like, a structure having a lid with a pull-top mechanism capable of easy opening is known.

A conventional pull-top can comprises a body made of stainless steel or aluminum and having an open top and a lid having a pull-top mechanism and caulked at the opening portion of the body. For example, the pull-top mechanism of a beverage can comprises a cut-open portion constituted by a saddle-shaped groove formed by pressing and a pull-tab joined with a pin so as to be in contact with the peripheral surface of the lid. This pull-top mechanism can be opened by bending the lid portion located inside the saddle-shaped cut-open portion toward the body upon raising the pull-tab with a finger. The lid is made of aluminum so that the lid may be easily cut along the saddle-shaped cut-open portion of the pull-top mechanism.

For example, an organic resin film such as a polyethylene terethphalate film is laminated on the inner surface of the body to prevent the contents from directly contacting the body material such as stainless steel or aluminum, thereby preventing degradation of the quality of the contents.

On the other hand, when an organic resin film such as the polyethylene terephthalate film is laminated on the inner surface of the lid attached with the pull-top mechanism, the pull-top mechanism can hardly cut the lid because the organic resin film has a high tear (fracture) strength. As a result, the lid cannot practically be opened by the pull-top mechanism.

Under the above circumstances, for example, an epoxy-phenol resin thin film having a thickness on the order of submicrons is formed on the inner surface of the lid by baking finish, so that the contents can be protected without coming into contact with aluminum as the lid material and without impairing the opening properties of the pull-top mechanism.

Baking finish on the inner surface of the lid with the epoxy-phenol resin thin film results in a poor working environment and increases the running cost because a very large amount of water is required after coating. In addition, the resin thin film formed on the inner surface of the lid by baking finish provides poorer protection for contents than the organic resin film laminated on the inner surface of the body.

BRIEF SUMMARY OF THE INVENTION

It is an object of the present invention to provide a pull-top can capable of protecting contents in a body without impairing the opening properties of a pull-top mechanism attached to a lid.

According to the present invention, there is provided a pull-top can comprising a body having an open top and an inner surface laminated with an organic resin film, and an aluminum lid caulked at an opening portion of the body and having a pull-top mechanism, wherein the inner surface of the lid on the body side is laminated with a porous organic resin film having a large number of small through pores by an adhesive layer sandwiched between the inner surface of the lid and the porous organic resin film.

According to the present invention, there is also provided a pull-top can comprising a body having an open top and an inner surface laminated with an organic resin film, and an aluminum lid caulked at an opening portion of the body and having a pull-top mechanism, wherein the inner surface of the lid on the body side is laminated with a porous organic resin film having a large number of small non-through pores by an adhesive layer sandwiched between the inner surface of the lid and the porous organic resin film.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 12 is a sectional view of the shoulder portion of the pull-top can shown in FIG. 10;

FIG. 13 is an enlarged sectional view of a lid shown in FIG. 10;

FIG. 14 is a perspective view showing the pull-top can shown in FIG. 10 in the open state;

DETAILED DESCRIPTION OF THE INVENTION

Figure 1:
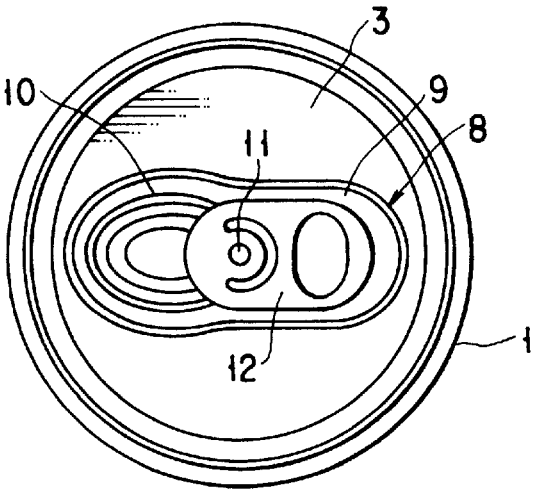
FIG. 1 is a plan view of a beverage pull-top can of the first embodiment according to the present invention.

Pull-top cans according to the present invention will be described below.

A pull-top can comprises a body having an open top and an inner surface laminated with an organic resin film, and an aluminum lid caulked at an opening portion of the body and having a pull-top mechanism. For example, the pull-top mechanism of a beverage pull-top can comprises a cut-open portion constituted by a saddle-shaped groove formed by punching and a pull-tab joined with a pin so as to be in contact with the peripheral surface of the lid. The inner surface of the lid on the body side is arranged a porous organic resin film having a large number of small through pores. An adhesive layer is sandwiched between the inner surface of the lid and the porous organic resin film. Therefore, the inner surface of the lid is laminated with the porous organic resin film by the adhesive layer.

The body is made of, e.g., stainless steel or aluminum.

Examples of the organic resin film laminated on the inner surface of the body are a polyester film, and an oriented polypropylene film.

The porous organic resin film laminated on the inner surface of the lid is manufactured by a porous film manufacturing apparatus disclosed in U.S. Pat. No. 5,257,923. This manufacturing apparatus comprises: a supply means for supplying an elongated film; a piercing unit having a first roll which is rotatable and has an outer surface on which a large number of particles (e.g., diamond particles) having sharp edges and a Mohs hardness of 5 or more are attached and a second roll rotatable in a direction opposite to that of the first roll, the elongated film being passed between the first and second rolls disposed opposing each other, with one of the rolls being stationary, while the other roll being disposed movable in an opposite direction to the one roll; and a pressure adjusting means disposed near the two end portions of the movable roll to adjust an urging force from each roll to the film.

The porous organic resin film preferably has a form in which through pores having an average opening size of 0.5 to 100 $\mu$m are formed in an organic resin film such as a polyester film (e.g., polyethylene terephthalate film), a nylon film, or an oriented polyropylene film at a density of 500 pores/cm$^2$ or more. A porous organic resin film having such average opening size and density has a tear strength much lower than and tearing properties (fracture properties) better than an organic resin film having no through pores.

The average opening size of the porous organic resin film is limited to the above range due to the following reason. When the average opening size is less than 0.5 $\mu$m, the lid having an inner surface laminated with the porous organic resin film cannot be easily opened by the pull-top mechanism. On the other hand, when the average opening size exceeds 100 $\mu$m, the contents inside the can cannot be sufficiently protected. The average opening size of the through pore is more preferably 2 to 50 $\mu$m.

The density of through pores in the porous organic resin film is limited due to the following reason. When the density is less than 500 pores/cm$^2$, it is difficult to laminate a porous organic resin film having excellent tear properties on the inner surface of the lid. The upper limit of the density is not limited to a specific value. Note that through pores can be formed at a density of 25,000 pores/cm$^2$ at once by the above-mentioned porous film manufacturing apparatus. The density of through pores is more preferably 1,000 pores/cm$^2$ to 5,000 pores/cm$^2$.

The organic resin film preferably has a thickness of 10 to 40 $\mu$m. When the thickness of the organic resin film is less than 10 $\mu$m, the contents inside the can may not be sufficiently protected. On the other hand, when the thickness of the organic resin film exceeds 40 $\mu$m, the tear properties of the film suffer and it becomes difficult to bend the saddle-shaped cut-open portion toward the body side upon pulling the pull-tab of the pull-top mechanism with a finger even if a large number of small through pores are formed in the film. The thickness of the organic resin film is more preferably 12 to 25 $\mu$m.

The adhesive can be selected from general adhesives applied to food. The thickness of the adhesive layer is preferably set to 5 to 20 $\mu$m from the viewpoints of tearing properties and protection of contents.

The lid is manufactured as follows. An adhesive is coated on one surface of a porous organic resin film having a large number of small through pores described above to form an adhesive layer. Subsequently, the porous organic resin film is laminated on one surface of, e.g., an aluminum thin plate by the adhesive layer, the resultant aluminum thin film is punched into a circular shape, and a cut-open portion or the like constituted by a saddle-shaped groove is formed by pressing. A pull-tab is then joined through a pin on a surface (outer surface) opposite to the organic resin film coating surface.

The pull-top can according to the present invention, as described above, comprises a body having an open top and an inner surface laminated with an organic resin film, and an aluminum lid caulked at an opening portion of the body and having a pull-top mechanism. The inner surface of the lid on the body side is laminated with a porous organic resin film having a large number of small through pores by an adhesive layer. For example, the pull-top mechanism of a beverage pull-top can comprises a cut-open portion constituted by a saddle-shaped groove formed by punching and a pull-tab joined with a pin so as to be in contact with the peripheral surface of the lid.

In the pull-top can having this structure, when the pull-tab of the pull-top mechanism is vertically raised with a finger, the end portion of the pull-tab near the pin joint urges the lid surface portion located inside the saddle-shaped cut-open portion toward the body. In urging the end portion of the pull-tab, a large number of small through pores acting as the tear start points (fracture points) are formed in the porous organic resin film laminated on the inner surface of the lid. For this reason, the aluminum lid and the porous organic resin film are cut along the saddle-shaped groove. The lid portion located inside the saddle-shaped cut-open portion is bent inside the body to open the can.

When the porous resin film is to be laminated to the inner surface of the lid by the adhesive layer, a portion of the adhesive enters a large number of through pores formed in the porous organic resin film to fill some through pores. Even the porous organic resin film filled with the adhesive in this manner has better tear properties than an organic film having no through pores.

The pull-top can according to the present invention can be easily opened without interfering the opening properties of the pull-top mechanism with the porous organic resin film formed on the inner surface of the lid. In addition, an organic resin film is laminated on the inner surface of the body, the porous organic resin film is laminated on the inner surface of the lid through the adhesive layer, and the through pores are partially filled with the adhesive. For these reasons, the contents do not come into direct contact with the material such as aluminum constituting the body and the lid, thereby preventing oxidation of the contents and hence maintaining high quality of the contents for a long period of time.

In the pull-top can according to the present invention, the porous organic resin film laminated on the inner surface of the lid has a better protection effect than a protective thin film formed by baking finish with an epoxy-phenol resin as in the conventional case. Therefore, high quality of the contents can be maintained for a long period of time, and at the same, a cleaning process requiring a large amount of water upon coating as in baking finish can be eliminated to greatly reduce the running cost.

Another pull-top can according to the present invention will be described in detail below.

A pull-top can comprises a body having an open top and an inner surface laminated with an organic resin film, and an aluminum lid caulked at an opening portion of the body and having a pull-top mechanism. For example, the pull-top mechanism for a beverage comprises a cut-open portion constituted by a saddle-shaped groove formed by punching and a pull-tab joined with a pin so as to be in contact with the peripheral surface of the lid. The inner surface of the lid on the body side is arranged a porous organic resin film having a large number of small blind holes non-through pores. An adhesive layer is sandwiched between the inner surface of the lid and the porous organic resin film. Therefore, the inner surface of the lid is laminated with the porous organic resin film by the adhesive layer.

The body and the organic resin film laminated on the inner surface of the body are same as those of the pull-top can described above.

A porous organic resin film laminated on the inner surface of the lid is manufactured by the porous film manufacturing apparatus disclosed in U.S. Pat. No. 5,257,923. The porous organic resin film may be adhered to the inner surface of the lid such that the openings of a plurality of non-through pores formed in the film are located on the inner surface side of the lid or a side opposite to the inner surface of the lid. In the former case, a portion of the adhesive layer sandwiched between the lid and the porous organic resin film fills a large number of non-through pores through their opening portions.

The porous organic resin film preferably has a form in which non-through pores having an average opening size of 0.5 to 100 $\mu$m are formed in an organic resin film such as a polyester film (e.g., polyethylene terephthalate film), a nylon film, or an oriented polyropylene film at a density of 500 pores/cm$^2$ or more. A porous organic resin film having such average opening size and density has a tear strength much lower than and tearing properties (fracture properties) better than an organic resin film having no non-through pores.

The average opening size of the porous organic resin film is limited to the above range due to the following reason. When the average opening size is less than 0.5 $\mu$m, the lid having an inner surface laminated with the porous organic resin film cannot be easily opened by the pull-top mechanism. On the other hand, when the average opening size exceeds 100 $\mu$m, the contents inside the can cannot be sufficiently protected. The average opening size of the non-through pore is more preferably 2 to 50 $\mu$m.

The density of non-through pores in the porous organic resin film is limited due to the following reason. When the density is less than 500 pores/cm$^2$, it is difficult to laminate a porous organic resin film having excellent tear properties on the inner surface of the lid. The upper limit of the density is not limited to a specific value. Note that non-through pores can be formed at a density of 25,000 pores/cm$^2$ at once by the above-mentioned porous film manufacturing apparatus. The density of the non-through pores is more preferably 1,000 pores/cm$^2$ to 5,000 pores/cm$^2$.

The organic resin film preferably has a thickness of 10 to 40 $\mu$m. When the thickness of the organic resin film is less than 10 $\mu$m, the contents inside the can may not be sufficiently protected. On the other hand, when the thickness of the organic resin film exceeds 40 $\mu$m, it is difficult to bend the saddle-shaped cut-open portion toward the body side upon pulling the pull-tab of the pull-top mechanism with a finger even if a large number of small non-through pores are formed in the film to degrade the tear properties. The thickness of the organic resin film is more preferably 12 to 25 $\mu$m.

The adhesive can be selected from general adhesives applied to food. The thickness of the adhesive layer is preferably set to 5 to 20 $\mu$m from the viewpoints of tearing properties and protection of contents.

The lid is manufactured as follows. An adhesive is coated on one surface of a porous organic resin film having a large number of small non-through pores described to form an adhesive layer. Subsequently, the porous organic resin film is laminated on one surface of, e.g., an aluminum thin plate by the adhesive layer, the resultant aluminum thin film is punched into a circular shape, and a cut-open portion or the like constituted by a saddle-shaped groove is formed by pressing. A pull-tab is then joined through a pin on a surface (outer surface) opposite to the organic resin film coating surface.

The pull-top can according to the present invention, as described above, comprises a body having an open top and an inner surface laminated with an organic resin film, and an aluminum lid caulked at an opening portion of the body and having a pull-top mechanism. The inner surface of the lid on the body side is laminated with a porous organic resin film having a large number of small non-through pores by an adhesive layer. For example, the pull-top mechanism of a beverage pull-top can comprises a cut-open portion constituted by a saddle-shaped groove formed by punching and a pull-tab joined with a pin so as to be in contact with the peripheral surface of the lid.

In the pull-top can having this structure, when the pull-tab of the pull-top mechanism is vertically raised with a finger, the end portion of the pull-tab near the pin joint urges the lid surface portion located inside the saddle-shaped cut-open portion toward the body. In urging the end portion of the pull-tab, a large number of small non-through pores acting as the tear start points (fracture points) are formed in the porous organic resin film laminated on the inner surface of the lid. For this reason, the aluminum lid and the porous organic resin film are cut along the saddle-shaped groove. The lid portion located inside the saddle-shaped cut-open portion is bent inside the body to open the can. In adhering the porous resin film to the inner surface of the lid through the adhesive layer, when the opening portions of a large number of non-through pores formed in the porous organic resin film are located on the inner surface side of the lid, a portion of the adhesive enters a large number of non-through pores formed in the porous organic resin film to fill some non-through pores. Even the porous organic resin film filled with the adhesive in this manner has better tear properties than an organic film having no non-through pores.

In the another pull-top can according to the present invention, the opening properties of the pull-top mechanism are not degraded, and oxidation of the contents in the body can be prevented, thereby maintaining high quality of the contents for a long period of time.

In the pull-top can according to the present invention, the porous organic resin film laminated on the inner surface of the lid has a better protection effect than a protective thin film formed by baking finish with an epoxy-phenol resin as in the conventional case. Therefore, high quality of the contents can be maintained for a long period of time, and at the same, a cleaning process requiring a large amount of water upon coating as in baking finish can be eliminated to greatly reduce the running cost.

The present invention will be described in detail with reference to the several views of the drawing below.

(First Embodiment)

Figure 2:
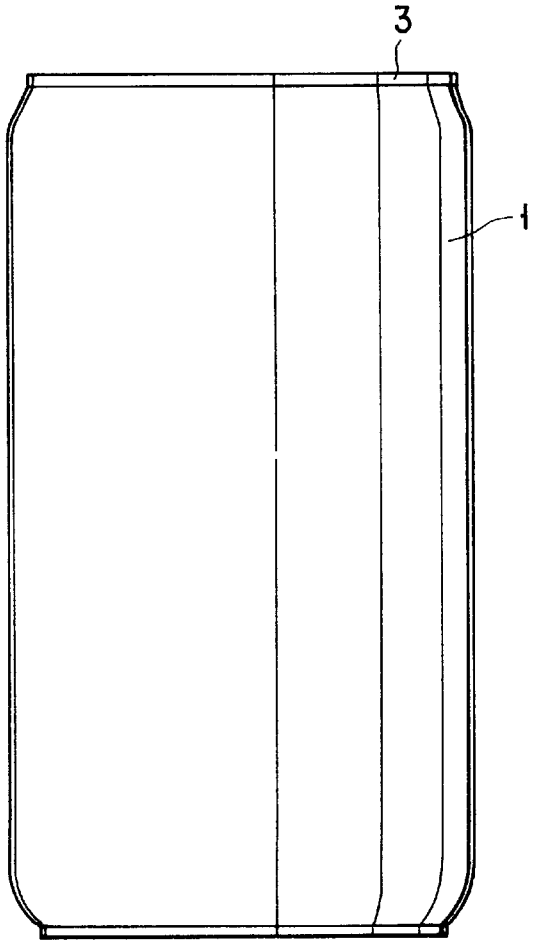
FIG. 2 is a front view of the pull-top can shown in FIG. 1.
Figure 3:
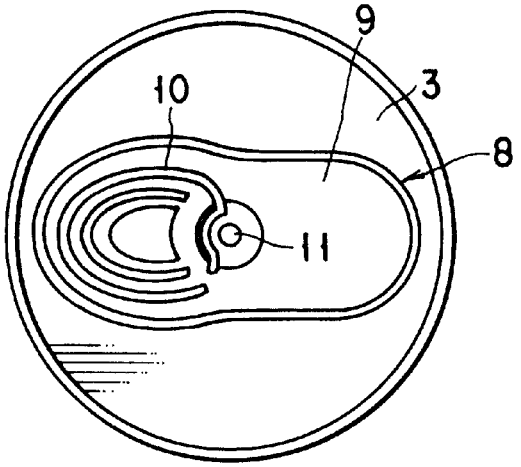
FIG. 3 is a plan view showing the inner surface of a lid used in the pull-top can shown in FIG. 1.
Figure 4:
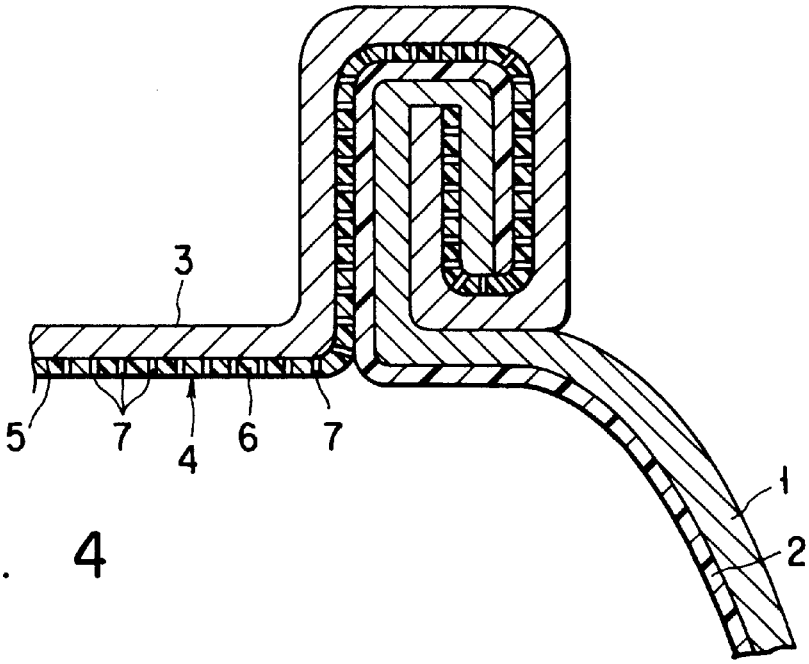
FIG. 4 is a sectional view of the shoulder portion of the pull-top can shown in FIG. 2.
Figure 5:
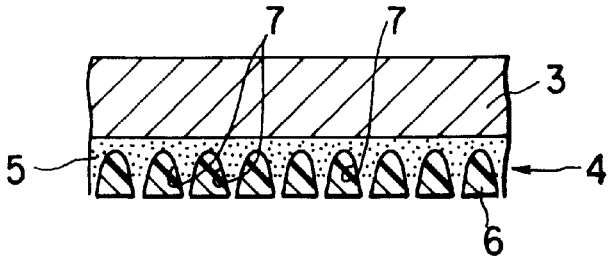
FIG. 5 is an enlarged sectional view of a lid shown in FIG. 4.

FIG. 1 is a plan view of a beverage pull-top can according to the first embodiment, FIG. 2 is a front view of the pull-top can shown in FIG. 1, FIG. 3 is a plan view showing the inner surface of a lid used in the pull-top can shown in FIG. 1, FIG. 4 is a sectional view of the shoulder portion of the pull-top can shown in FIG. 2, and FIG. 5 is an enlarged sectional view of a lid in FIG. 4.

A body 1 having an open top and made of, e.g., stainless steel is laminated with a polyethylene terephthalate film 2. An aluminum lid 3 having a thickness of, e.g., 30 μm is caulked and joined to the opening portion of the body 1. A porous polyethylene terephthalate film (porous PET film) 4 is laminated on the inner surface of the lid 3 by a 10 μm thick adhesive layer 5 made of, e.g., a two-liquid polyester-polyurethane and sandwiched between the inner surface of the lid 3 and the porous organic resin film 4, as shown in FIGS. 4 and 5. The porous PET film 4 has a structure in which through pores 7 having an average opening size of 70 to 80 μm are uniformly formed in a polyethylene terephthalate film 6 having a thickness of, e.g., 12 μm at a density of 5,000 pores/cm$^2$, as shown in FIG. 5. The adhesive of the adhesive layer 5 enters from the opening portions of the through pores 7 and fills the large number of through pores 7 formed in the porous PET film 4.

A pull-top mechanism 8 is formed on the lid 3. As shown in FIGS. 1 and 3, the pull-top mechanism 8 comprises a saddle-shaped recessed portion 9 formed on the outer surface of the lid 3 by pressing, a cut-open portion 10 constituted by a saddle-shaped groove formed in the curved region of the recessed portion 9 and cut upon opening the can, and an elongated pull-tab 12 joined by a pin 11 located near the center to the recessed portion 9 opposing the cut-open portion 10. The pull-tab 12 has two holes in contact with the surface of the recessed portion 9.

Opening of the pull-top can having this structure will be described with reference to FIGS. 6 to 9.

Figure 6:
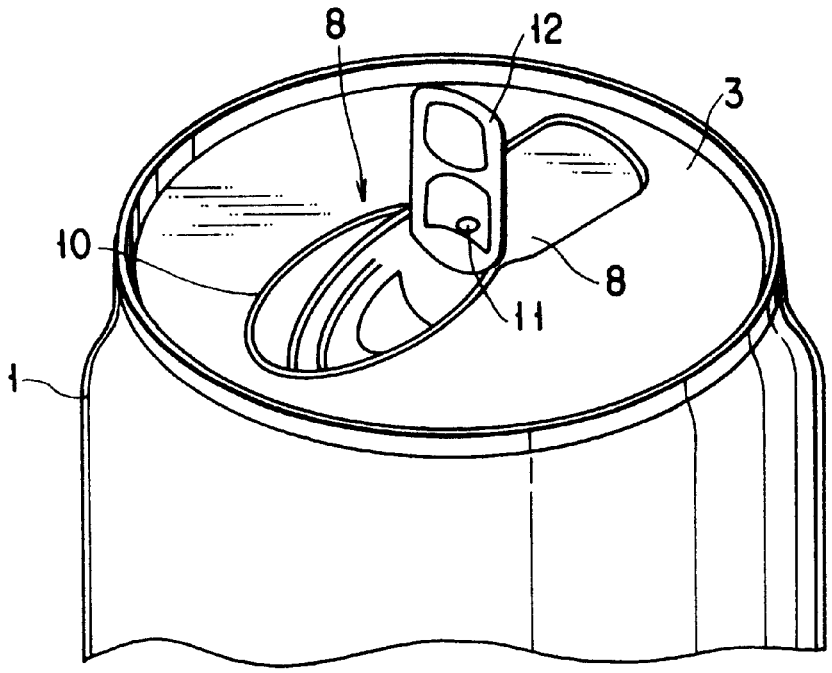
FIG. 6 is a perspective view showing the pull-top can shown in FIG. 1 in the open state.
Figure 7:
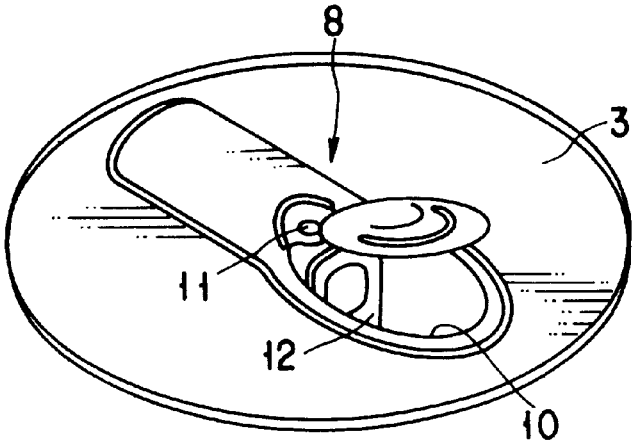
FIG. 7 is a perspective view showing the inner surface side of the open lid in FIG. 6.

When a consumer holds the body 1 with one hand and vertically raises the pull-tab 12 of the pull-top mechanism 8 with a finger of the other hand, the end portion of the pull-tab 12 near the joint with the pin 11 urges the surface portion of the lid 3 which is located inside the saddle-shaped cut-open portion 10 toward the body 1, as shown in FIG. 6. In urging the lid surface portion by the end portion of the pull-tab 12, since the porous PET film 4 which has the large number of through pores 7 and can be easily torn is laminated on the inner surface of the lid 3, the lid 3 and the porous PET film 4 are cut along the groove of the saddle-shaped cut-open portion 10. As shown in FIGS. 6 and 7, the portion of the lid 3 which is located inside the saddle-shaped cut-open portion 10 is bent inside the body 1, thereby opening the can.

Figure 8:
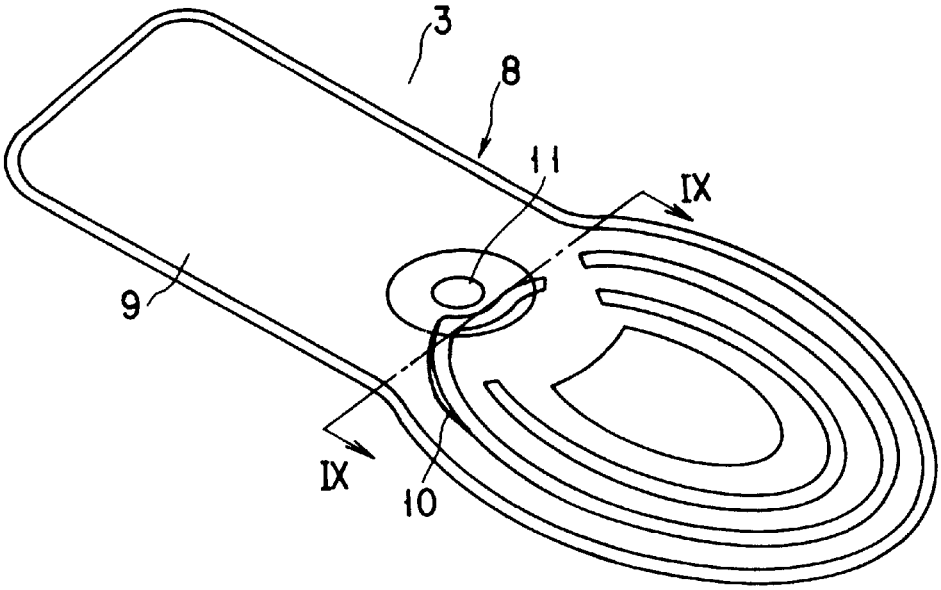
FIG. 8 is a perspective view of the inner surface side of the lid in an initial opening stage of the pull-top can shown in FIG. 1.
Figure 9:
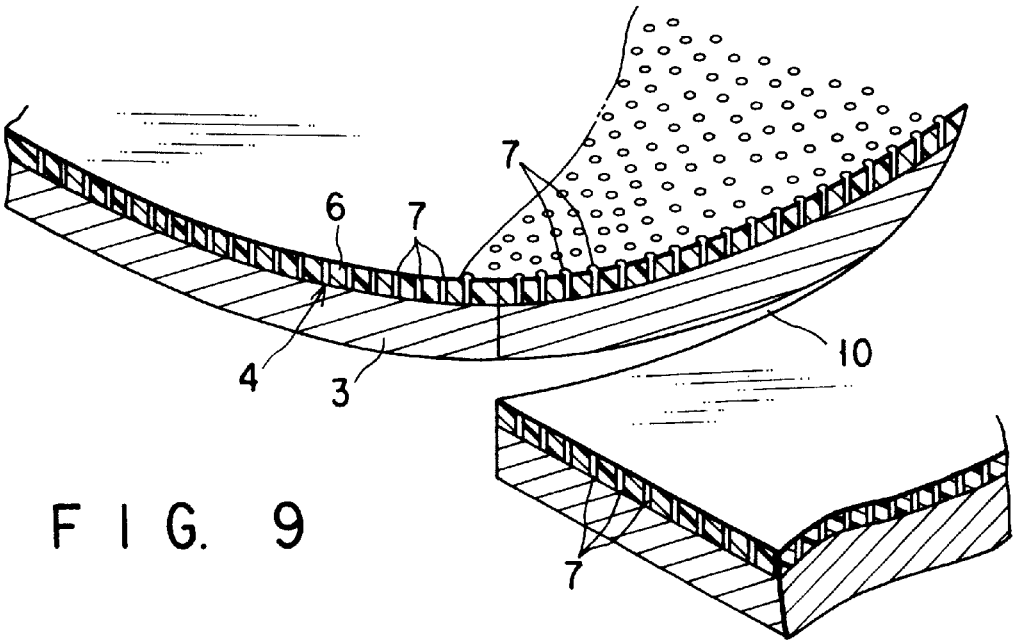
FIG. 9 is a sectional view of the inner surface side of the lid along the line IX—IX in FIG. 8.

More specifically, when the portion of the lid 3 which is located inside the saddle-shaped cut-open portion 10 is urged by the end portion of the pull-tab 12, the large number of through pores 7 formed in the porous PET film 4 laminated on the inner surface of the lid 3 serve as tear start points (fracture start points). For this reason, as shown in FIGS. 8 and 9, in the initial urging stage, the lid is cut along the groove of the cut-open portion 10 which is located around the urged portion. At the same time, the porous PET film 4 laminated on the inner surface of the lid 3 is cut along the large number of through pores 7. When the pull-tab 12 is vertically raised, the urging stroke to the portion of the lid 3 which is located inside the saddle-shaped cut-open portion 10 increases. Therefore, the groove of the cut-open portion 10 can be cut long together with the porous PET film 4, and the portion of the lid 3 which is located inside the saddle-shaped cut-open portion 10 is bent inside the body 1, thereby opening the can.

In use of a lid laminated with a PET film having no pores, even if a pull-tab is vertically raised to cause the end portion of the pull-tab to urge a lid portion inside a saddle-like cut-open portion, the teat strength (fracture strength) of the PET film having no pores is much higher than the urging force, and the PET film having no pores cannot be torn by the urging force. For this reason, even if the PET film having no pores is laminated on the lid upon forming the saddle-like cut-open portion on the lid, this interferes with formation of a cut along the groove of the cut-open portion located around the urged portion. Therefore, it is difficult to open the can using the pull-top mechanism.

In the pull-top can of the first embodiment, since the PET film 4 serving as a protective film for the inner surface of the lid 3 is porous due to the presence of the large number of through pores 7, unlike the PET film having no pores, the PET film 4 does not degrade the opening properties of the pull-top mechanism 8, thereby allowing easy opening of the can.

The PET film 2 is laminated on the inner surface of the body 1. The porous PET film 4 having the large number of small through pores 7 is laminated on the inner surface of the lid 3 by the adhesive layer 5. The adhesive fills the through pores 7 to provide good barrier properties. For this reason, the contents in the body 1 do not come into direct contact with the material such as stainless steel constituting the body 1 and aluminum constituting the lid 3 to prevent oxidation or the like of the contents. As a result, even if the beverage pull-top can is preserved for a long period of time, the quality of the contents can be kept at the same level as that in pouring the contents into the body 1.

Since the protective film on the inner surface of the lid 3 is made of the laminated porous PET film 4 by the adhesive layer 5, the quality of the contents can be maintained for a longer period of time than that in use of a protective thin film formed by conventional baking finish with an epoxy-phenol resin, and at the same time, a cleaning process requiring a large amount of water upon coating as in baking finish, thereby greatly reducing the running cost.

(Second Embodiment)

Figure 10:
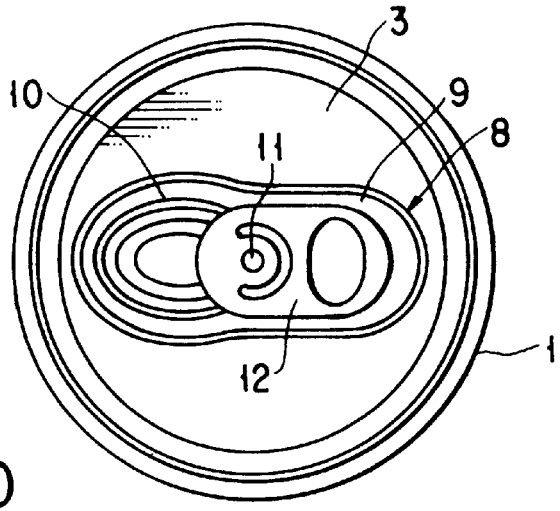
FIG. 10 is a plan view of a beverage pull-top can of the second embodiment of the present invention.
Figure 11:
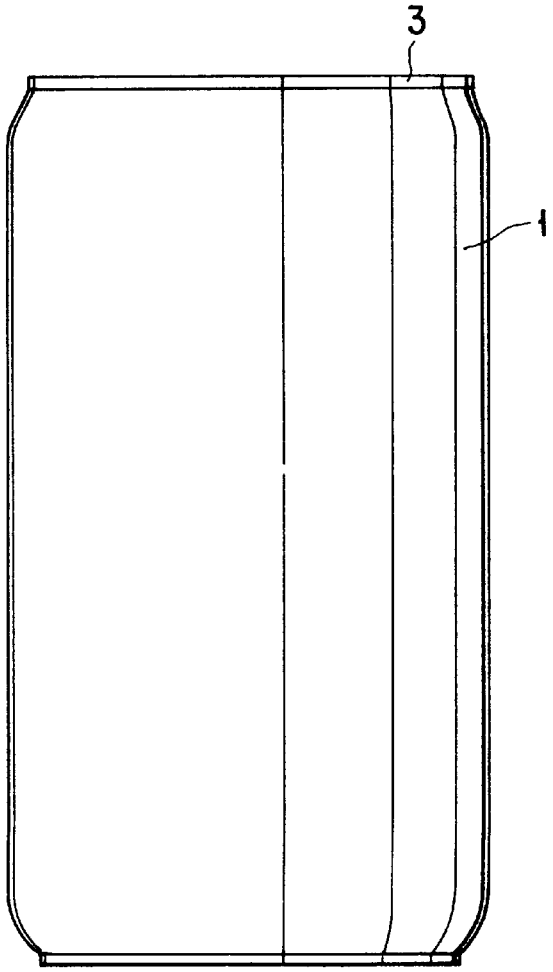
FIG. 11 is a front view of the pull-top can shown in FIG. 10.

FIG. 10 is a plan view of a beverage pull-top can according to the second embodiment, FIG. 11 is a front view of the pull-top can shown in FIG. 10, FIG. 12 is a sectional view of the shoulder portion of the pull-top can shown in FIG. 10, and FIG. 13 is an enlarged sectional view of a lid in FIG. 12. The same reference numerals as in the first embodiment denote the same parts in the second embodiment, and a detailed description thereof will be omitted.

The pull-top can of the second embodiment comprises a body 1 having an open top and made of stainless steel, and an aluminum lid 3 having a thickness of, e.g., 300 μm and caulked and joined to the opening portion of the body 1. A polyethylene terephthalate film 2 is laminated on the inner surface of the body 1. A porous polyethylene terephthalate film (porous PET film) 14 having a large number of small non-through pores 13 is laminated on the inner surface of the lid 3 by a 10 μm thick adhesive layer 5 made of a two-liquid polyester-polyurethane adhesive and sandwiched between the inner surface of the lid 3 and the porous organic resin film 14 so that the opening portions of the non-through pores 13 are located on a side opposite to the inner surface of the lid 3, as shown in FIGS. 12 and 13. The porous PET film 14 has a structure in which non-through pores 13 having an average opening size of 70 to 80 μm are uniformly formed in a polyethylene terephthalate film 15 having a thickness of, e.g., 12 μm at a density of 5,000 pores/cm$^2$, as shown in FIG. 13. A pull-top mechanism 8 is formed on the lid 3, as shown in FIG. 10.

Figure 15:
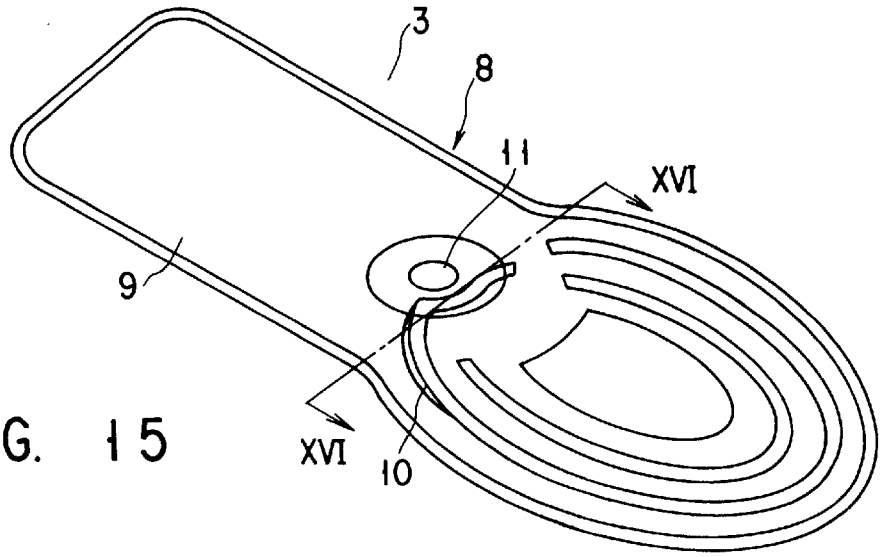
FIG. 15 is a perspective view showing the inner surface side of the lid in the initial open state of the pull-top can shown in FIG. 10.
Figure 16:
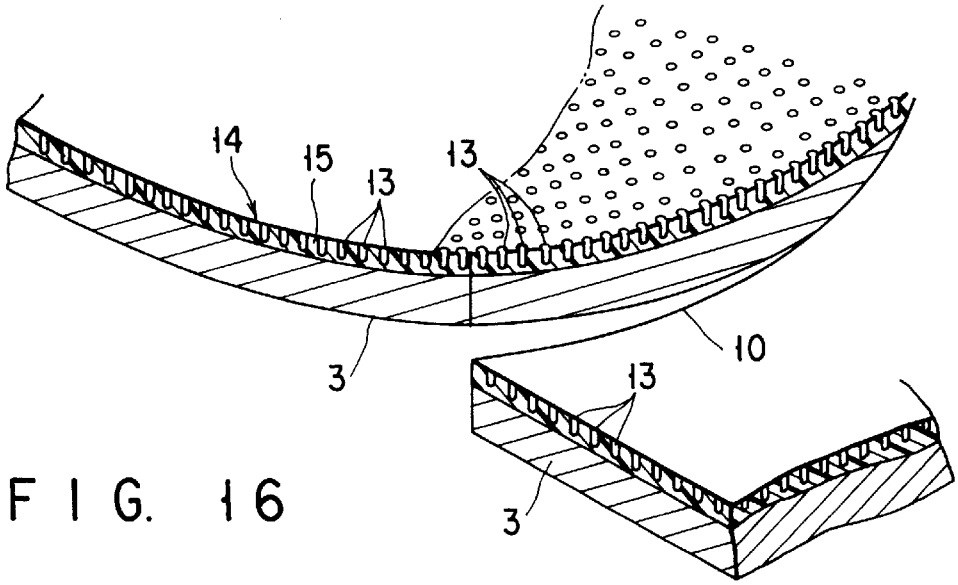
FIG. 16 is a sectional view showing the inner surface side of the lid along the like XVI—XVI in FIG. 15.

Opening of the pull-top can having this structure will be described with reference to FIGS. 14 to 16.

When a consumer holds the body 1 with one hand and vertically raises a pull-tab 12 of the pull-top mechanism 8 with a finger of the other hand, the end portion of the pull-tab 12 near the joint with a pin 11 urges the surface portion of the lid 3 which is located inside a saddle-shaped cut-open portion 10 toward the body 1, as shown in FIG. 14. In urging the lid surface portion by the end portion of the pull-tab 12, since the porous PET film 14 which has the large number of non-through pores 13 and can be easily torn is laminated on the inner surface of the lid 3, the lid 3 and the porous PET film 14 are cut along the groove of the saddle-shaped cut-open portion 10. As shown in FIG. 14, the portion of the lid 3 which is located inside the saddle-shaped cut-open portion 10 is bent inside the body 1, thereby opening the can.

More specifically, when the portion of the lid 3 which is located inside the saddle-shaped cut-open portion 10 is urged by the end portion of the pull-tab 12, the large number of non-through pores 13 formed in the porous PET film 14 laminated on the inner surface of the lid 3 serve as tear start points (fracture start points). For this reason, as shown in FIGS. 15 and 16, in the initial urging stage, the lid is cut along the groove of the cut-open portion 10 which is located around the urged portion. At the same time, the porous PET film 14 laminated on the inner surface of the lid 3 is cut along the large number of non-through pores 13. When the pull-tab 12 is vertically raised, the urging stroke to the portion of the lid 3 which is located inside the saddle-shaped cut-open portion 10 increases. Therefore, the groove of the cut-open portion 10 can be cut long together with the porous PET film 14, and the portion of the lid 3 which is located inside the saddle-shaped cut-open portion 10 is bent inside the body 1, thereby opening the can.

In the pull-top can of the second embodiment, since the PET film 14 serving as a protective film for the inner surface of the lid 3 is porous due to the presence of the large number of non-through pores 13, unlike the PET film having no pores, the PET film 14 does not degrade the opening properties of the pull-top mechanism 8, thereby allowing easy opening of the can.

The PET film 2 is laminated on the inner surface of the body 1. The porous PET film 14 having the large number of small non-through pores 13 is laminated on the inner surface of the lid 3 by the adhesive layer 5. The porous PET film 14 has the non-through pores 13 to maintain good barrier properties of the film itself. For this reason, the contents in the body 1 do not come into direct contact with the material such as stainless steel constituting the body 1 and aluminum constituting the lid 3 to prevent oxidation or the like of the contents. As a result, even if the beverage pull-top can is preserved for a long period of time, the quality of the contents can be kept at the same level as that in pouring the contents into the body.

Since the protective film on the inner surface of the lid 3 is made of the laminated porous PET film 14 by the adhesive layer 5, the quality of the contents can be maintained for a longer period of time than that in use of a protective thin film formed by conventional baking finish with an epoxy-phenol resin, and at the same time, a cleaning process requiring a large amount of water upon coating as in baking finish, thereby greatly reducing the running cost.

Figure 17:
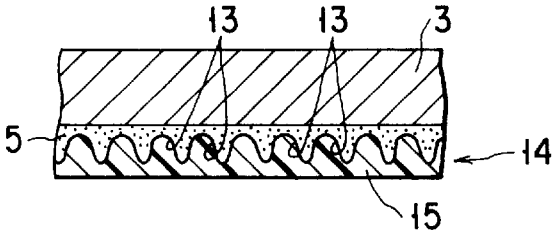
FIG. 17 is an enlarged sectional view of another lid in a pull-top can according to the present invention.

In the second embodiment, the porous PET film 14 is laminated on the inner surface of the lid 3 through the adhesive layer 5 such that the opening portions of the non-through pores 13 are located at a side opposite to the inner surface of the lid 3, as shown in FIGS. 12 and 13. However, as shown in FIG. 17, the porous PET film 14 may be laminated on the inner surface of the lid 3 through the adhesive layer 5 such that the opening portions of the non-through pores 13 are located on the inner surface side of the lid 3. In this case, the adhesive of the adhesive layer 5 enters from the opening portions of the large number of non-through pores 13 of the porous PET film 14 and fills the non-through pores 13. Even the porous organic resin film 14 having the large number of non-through pores 13 filled with the adhesive in this manner has better tear properties than an organic film having no non-through pores. Therefore, the pull-top can having the lid 3 laminated with the porous PET film 14 has good opening properties and the protection effect of the stored contents as in the second embodiment.

The first and second embodiments have exemplified beverage pull-top cans. However, the present invention is also applicable to a pull-top can which stores seafood or the like and whose entire lid can be opened along the edge of the opening portion of the body.

As has been described above, according to the present invention, there can be provided a pull-top can capable of protecting contents from the material of the body and lid without impairing the opening properties of the pull-top mechanism attached to the lid, and maintaining the quality of the contents such as beverages, beer, and any other seafood for a long period of time.

Additional advantages and modifications will readily occur to those skilled in the art. Therefore, the invention in its broader aspects is not limited to the specific details and representative embodiments shown and described herein. Accordingly, various modifications may be made without departing from the spirit and scope of the general inventive concept as defined by the appended claims and their equivalent.

What is claimed is:

1. A pull-top can comprising a body having an open top and an inner surface laminated with an organic resin film, and an aluminum lid caulked at an opening portion of said body and having a pull-top mechanism, said lid having an inner lid surface disposed towards the inner surface of said body and an outer lid surface disposed away from the inner surface of said body, the inner lid surface laminated with a porous organic resin film having a large number of small through pores by an adhesive layer sandwiched between the inner surface of said lid and said porous organic resin film, and said small through pores having an average opening size of 0.5 to 100 μm at a density of not less that 500 pores/cm$^2$, said adhesive layer partially filling the large number of through pores of said porous resin film.

2. A can according to claim 1, wherein said body consists of a material selected from the group consisting of stainless steel and aluminum.

3. A can according to claim 1, wherein said organic resin film laminated on the inner surface of said body is a polyethylene terephthalate film.

4. The pull-top can of claim 1, wherein said porous organic resin film has a thickness of from 10 to 40 μm.

5. The pull-top can of claim 1, wherein said adhesive layer has a thickness of from 5 to 20 μm.

* * * * *